United States Patent [19]

Schuster

[11] 4,035,989

[45] July 19, 1977

[54] MACHINE FOR ERECTING, FILLING AND CLOSING FLAT-FOLDABLE CARTONS

[76] Inventor: Wilhelm Schuster, Lilienstr. 11, Ettlingen-Bruchhausen, Germany, 7505

[21] Appl. No.: 647,092

[22] Filed: Jan. 7, 1976

[30] Foreign Application Priority Data

Jan. 7, 1975 Germany ..... 2500392

[51] Int. Cl.[2] ..... B65B 5/02; B65B 43/28; B65B 43/32

[52] U.S. Cl. ..... 53/186; 53/258; 53/376; 221/233; 221/263

[58] Field of Search ..... 53/186, 183, 191, 258, 53/255, 284, 376, 375, 159; 221/233, 234, 238, 263, 268

[56] References Cited

U.S. PATENT DOCUMENTS

| | | | |
|---|---|---|---|
| 1,641,794 | 9/1927 | Weber | 53/376 X |
| 1,724,124 | 8/1929 | Boileau | 53/376 |
| 1,746,835 | 2/1930 | Jones | 53/186 X |
| 1,766,298 | 6/1930 | Macke | 221/238 |
| 2,380,758 | 7/1945 | Hohl | 53/376 X |
| 2,682,210 | 6/1954 | Bivans | 53/376 X |
| 3,088,257 | 5/1963 | Penley | 53/258 X |
| 3,343,335 | 9/1967 | Pearson | 53/186 |
| 3,443,357 | 5/1969 | Bacon et al. | 53/186 |
| 3,452,515 | 7/1969 | Bongartz et al. | 53/376 |
| 3,613,526 | 10/1971 | Jones | 53/186 X |

*Primary Examiner*—Othell M. Simpson

*Assistant Examiner*—Horace M. Culver

*Attorney, Agent, or Firm*—McGlew and Tuttle

[57] ABSTRACT

A machine for erecting, filling and closing rectangular cartons, comprises a magazine for storing a plurality of flat folded cartons in a stack which has a bottom discharge opening for individual removal of each carton. A support bar located below the discharge opening defines a first station to which each carton in succession is moved past deflection means which effect a preliminary erection of the carton by deflecting side walls upwardly from the bottom. The shifting member is movable backwardly and forwardly over the support bar and has means for maintaining the carton in an upright erected condition while moving it and while it is being filled. A product stuffer includes a product magazine for storing a stack of individual products to be filled into the container which is located adjacent the first station and which includes a movable product support member carrying the lower portion of the stack which is movable away from the remaining portion of the stack to transport the lower portion away and to support the remaining portion. The product stuffer also includes a sliding member which is movable to push the products which have been removed from the stack into the individual carton. Pusher means are also provided for engaging the filled carton and for moving it out of the first station to a second station spaced from the first station at which the carton is engaged by closing devices for closing the flaps.

13 Claims, 14 Drawing Figures

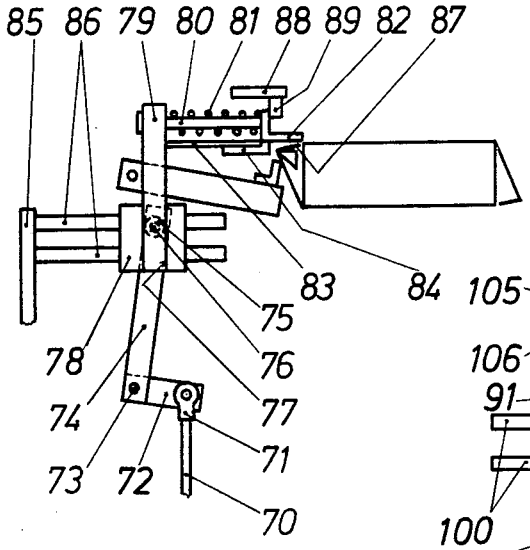
Fig. 9
Fig. 11
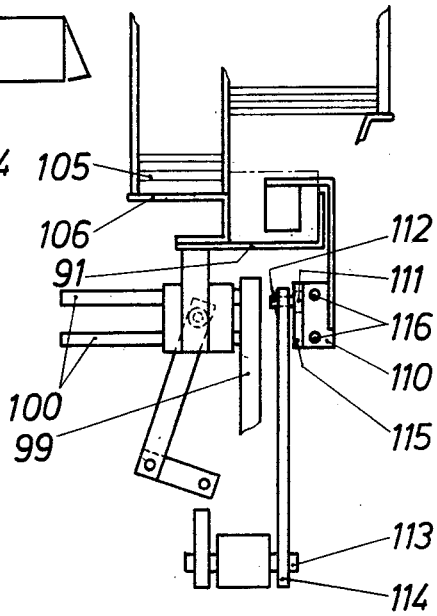
Fig. 10
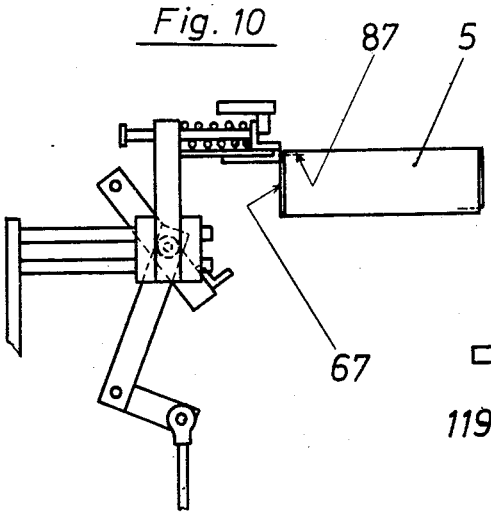
Fig. 12
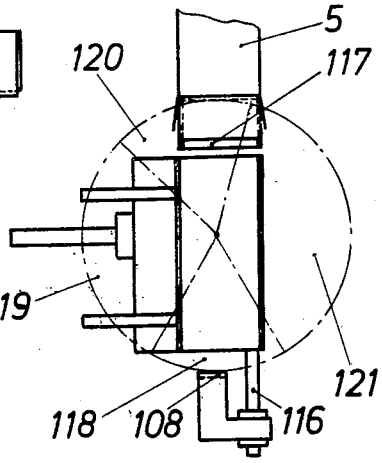

MACHINE FOR ERECTING, FILLING AND CLOSING FLAT-FOLDABLE CARTONS

FIELD AND BACKGROUND OF THE INVENTION

This invention relates in general to the construction of devices for packaging products into individual containers or cartons and, in particular, to a new and useful device which includes means for erecting flat folded cartons and holding them in an upright condition while they are filled with a product and for thereafter closing the flaps of the carton after the carton has been filled.

DESCRIPTION OF THE PRIOR ART

The present invention relates particularly to a machine for packaging products automatically in folding boxes, in which the boxes are taken in flat state from a pile magazine and individually held, at several sides, in a fixed position in the machine and means are provided for varying the carton size capacity of the machine within relatively large limits.

Packaging machines comprising a plurality of working stations, for example four, are well known. In such machines, the righted folding boxes are conveyed by means of bucket or tappet chains, of oscillating bars or of a turntable. In all cases, a plurality of pockets is needed for receiving the folding boxes. Machines of such design are expensive and require a large operating space.

Cartoning machines are also known in which, in one station, the folding box is righted, the product is pushed in, and then the filled folding box is shifted, by means of cyclically moving pushers, through a plurality of stations which are equipped with closure guides adapted to the respective size, whereby the two ends of each folding box are closed.

Cartoning machines are also known in which the filled folding boxes are pushed, by means of cyclic pusher movements, through a plurality of stations. The front ends of the folding boxes are closed partly by definite sequences of mechanical motions and partly by the action of sized closure guides. As a rule, machines of this kind require a relatively long conveyance path. In consequence, it cannot be avoided that in any such operation, the folding boxes which are not closed push into each other. Because of the ramming pressure thus produced, deformations of the folding boxes are unavoidable if they are not filled with products which fill the box substantially. In any case, products contained in receptacles having a rotationally symmetrical cross-section, such as bottles or tubes, as well as collapsible packs, cannot be cartoned in machines of this kind.

Aside from these easily understandable limits in application, a use of cartoning machines of the just mentioned kind has another disadvantage in that, if only closure guides or closure guides in combination with a respective sequence of motions are provided, a relatively large number of component parts must be replaced while adjusting the machine to product and carton size changes.

Finally, there are known cartoning machines comprising a stationary pocket for receiving the product to be packaged, in which the product is fed into the respective folding box by the movement of a reciprocating pusher. Because of this reciprocating motion of the pusher, only a relatively short period of time is available for each refilling of the pocket so that, as a rule, in machines of this kind, an additional motion of the pusher is necessary in order to supply the pocket from a supply pile or the like. This additional pusher motion considerably increases the expenses of the construction.

SUMMARY OF THE INVENTION

The present invention is directed to a space-saving and low priced cartoning machine which is simple in design and reliable in operation, and which makes it possible, with an intentional omission of conveyor chains, oscillating bars or turntables for the folding boxes, to effect a substantially faultless and trouble-proof conveyance of flat folding boxes for packaging products. The invention provides a fixing of the folding boxes at working stations individually while holding them at several sides while treating them carefully, and permits closing of unequally sized folding boxes within relatively large size limits without requiring that the operating parts be interchanged. Finally, the invention provides movable holders which operatively define a pocket for the products to be packaged offering a relatively long period of time for manual refilling or capable of being supplied automtically from a supply magazine without any additional sequence of motion.

In accordance with the invention, the removal of flat folded cartons from a magazine, bringing them into an upright position, and filling and closing the boxes is effected in only two working stations which are located one after the other in the working direction and of which a first station comprises mechanical members by means of which a first station comprises mechanical members by means of which a flat folded box can be removed from a pile magazine, righted and held in upright position at four sides in the form of a pocket for the products to be packaged, and a second station comprises mechanical members by means of which the righted and filled box is held at four sides and closed.

According to a development of the invention, the mechanical members necessary for righting the folding boxes substantially comprise a guide bar having side and bottom portions for supporting the one side and bottom of the folding box located below a flat folded carton stack magazine. A shifting member adapted to perform a rectilinear motion is mounted above the guide bar and is displaceable, approximately at the height of the folding box, into a position above the guide bar to push the carton into an upright erected position.

Other features of the invention are that the near end of the second working station, i.e., the closing station, can be determined by the length of the guide bar, which length is advantageously made so as to exceed the width of the standard folding box. A discharge bar is provided in alignment with the guide bar, but is spaced therefrom by an adjustable distance, and the interspace thus produced corresponds to the width of the respective folding box.

According to a further development of the invention, for supporting the folding box, a receiving bar carried by, and hinged to wing levers or the like, is provided in the interspace and is operatively connected to a top bar which is provided above the space for the folding box and also carried by swing levers or the like in a manner such that the path of travel of the top bar resulting from the swing motion is longer than the corresponding path of travel of the receiving bar. In accordance with the invention, the top bar is provided with a bay-shaped recess corresponding to the width of the folding box, and after being lowered, the top bar engages over the folding box from above on three sides, while from below, the folding box is supported on the receiving bar and held in position between the guide bar and the discharge bar.

A further feature of the invention provides that the advance of the righted folding box from the first to the second working station is effected by means of a pusher which is mounted below the guide bar and designed as a swing arm which, in cooperation with the shifting member staying the folding box from the opposite side and the top, forms a frame compartment or pocket for holding the box during the advance.

By the displacement of the shifting member and the pusher, the filled folding box is conveyed, along the guide bar, from the first to the second working station, i.e., the closing station.

In accordance with the invention, the shifting member is provided with a second recess into which the closed folding box is lifted from the closing station and by which the box is held from above and on its side facing the first working station and, due to the motion of the shifting member, is shifted, in the advance direction, from this transfer position onto the discharge bar.

According to a further development of the invention, upon its disengagement by elevation from the closing station, the closed folding box is transported from the closing station by the motion of the shifting member mounted above.

In accordance with a further feature of the invention, the mechanical means for closing the folding box provided at the second working station substantially comprises a side-flap deflector, a folding guide for folding the tuck-end portion, swing members for swinging the closing flap toward the box, and a closing pusher. Advantageously, the closing pusher is designed as a double stroke pusher.

The mechanical means for closing the front side of the folding boxes are supported, in accordance with the invention, on a carrier bar which is fixedly secured to the machine, while the mechanical means for closing the rear side of the folding boxes are supported on a carrier bar which is displaceably mounted in a slideway, to permit an adjustment to unequal lengths of the folding boxes.

For reasons of expediency, simplicity and low costs, the invention provides that the mechanical means for closing the front and rear sides of the folding boxes are, at least approximately, of mutually identical design.

Two features of the invention complement themselves mutually. One of the features is that the pocket receiving the products to be packaged is mounted on a slide which is displaceable transversely to the direction in which the product is pushed into the boxes and performs a periodical reciprocating motion from a supply position into the box-filling position, and the other feature is that one wall of the pocket receiving the products is designed as a dosaging pusher and provided with a supporting portion by which the bottom side of the pile of products to be packaged is alternately supported and cleared.

Finally, the invention provides that at both ends of the pocket receiving the products to be packaged, the path of stroke of the pusher transferring the products into the folding box exceeds the length of the pocket, so that at each end of the stroke, the pusher travels beyond the pocket.

It is evident that the present invention offers many advantages. The most obvious advantage is that all of the working steps which are necessary in a fully automatic packaging machine adjustable to size within large limits are united in only two working stations. This makes it possible to obtain an extremely short overall length, of approximately 600 mm, for a folding box width of up to about 80 mm. This means that, without any difficulty, the machine can be installed at any working place provided for a purely manual activity, which place, in accordance with the usual standards corresponds to an area of the extension of approximately 800 mm.

A not less substantial advantage of the inventive packaging machine is that there is no need for the expensive and exacting conveying elements for the folding boxes nor for complicated stepping mechanisms or the like such as usual in the conventional machines. On the contrary, according to the invention, the folding boxes are conveyed as well as exactly fixed in the two working stations by means of a few, simple, motions controlled by open cams, as well as by means of several fixed bars.

Another advantage of the inventive machine is the ingenious and, at the same time, expedient arrangement of the mechanical means accomplishing the tuck-end closures of the folding box. These means are mounted, for the front side of the folding box, on a fixed carrier bar and, for the rear side of the folding box, on an adjustable carrier bar. To come to a correspondingly small or rugged construction of the provided packaging machine, it is understood that in practice, of course, the mechanical means both for the front and the rear side of the folding box are united in a common working station. Due to the adjustable carrier bar provided at the rear side of the folding box, a readjustment of the size capacity from a shorter to a longer box or inversely, while keeping the cross-section unchanged, is made possible within relatively large limits, without any exchange of the functional or controlling parts.

An essential advantage of the invention is also the design and location of the pocket for the products to be packaged, associated with the machine. The cyclically working pusher introducing the product into the righted folding box travels, at either side, beyond the longitudinal extension of the pocket so that the produce-receiving pocket can be displaced, during the period of overtravel in the filling phase, from its filling position into its supply position. During the back travel of the pusher, the pocket is charged in its supply position, by hand or also automatically; during the overtravel of the pusher at the rear side, the pocket is displaced into its box filling position. This ensures that the pocket may be continuously supplied with the product without effecting the filling speed. With an automatic charging from a pile magazine, the pocket effects the necessary motions automatically. This may save additional and, thereby, expensive charging devices.

Accordingly, it is an object of the invention to provide an improved machine for erecting, filling and closing rectangular cartons which are flat foldable before erection and which includes a movable support bar located below a discharge opening of the magazine, with suction means for moving each container in succession past the deflection means to tilt the sides of the folded carton to erect them upwardly from the bottom and which also includes means for engaging a remote side of the carton wall and pushing it against an upright member of the support stand to hold the container in a fully erected position while it is filled with a product and until it is engaged by pusher means to push it into a second station which is made up of a movable botton support member and top engageable member which holds the erected container filled with the product in a position at which the end flaps may be easily closed and which permits the easy transfer of the filled and closed container onto an adjustable discharge bar.

A further object of the invention is to provide a device for erecting, filling and closing flat foldable cartons which may be adjusted in respect to carton size and which includes a minimum number of stations, including one in which a carton is filled with a product, and another in which the end flaps are closed.

A further object of the invention is to provide a container stuffing device which includes means for supporting a stack of products which includes a lowermost tray portion supporting the lowermost portion of the stack which is displaceable laterally in respect to the stack to shift the lowermost portion of the products away from the stack and to support the remaining ones and to position the shifted away products to a position at which they may be pushed into a container.

A further object of the invention is to provide a device for closing end flaps of a container which is adapted to be located on a side of the container which is to be closed and which includes means for folding one side flap inwardly in the form of a pivotal member engageable with the side flap and a slide member which is engageable with the opposite side flap to close it after the first flap has been closed, and which also includes an upwardly movable member to engage a flap hinged to either the top or bottom of the container so as to push it toward the opposite top or bottom and which also includes means for tucking an outer end flap of the cover flap so that it will be tucked inside the container as it is moved toward the container body to close it.

A further object of the invention is to provide a device for erecting, filling and closing a container, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

BRIEF DESCRIPTION OF THE DRAWINGS

In the Drawings:

FIGS. 7, 8, 9 and 10 are views similar to FIG. 6 showing various operative positions of the device shown in FIG. 6;

FIG. 11 is a partial front elevational view of a filling device constructed in accordance with the invention usable on the machine shown in FIG. 1;

FIG. 12 is a top plan view of the filling device shown in FIG. 11;

DESCRIPTION OF THE PREFERRED EMBODIMENTS

Figure 1:
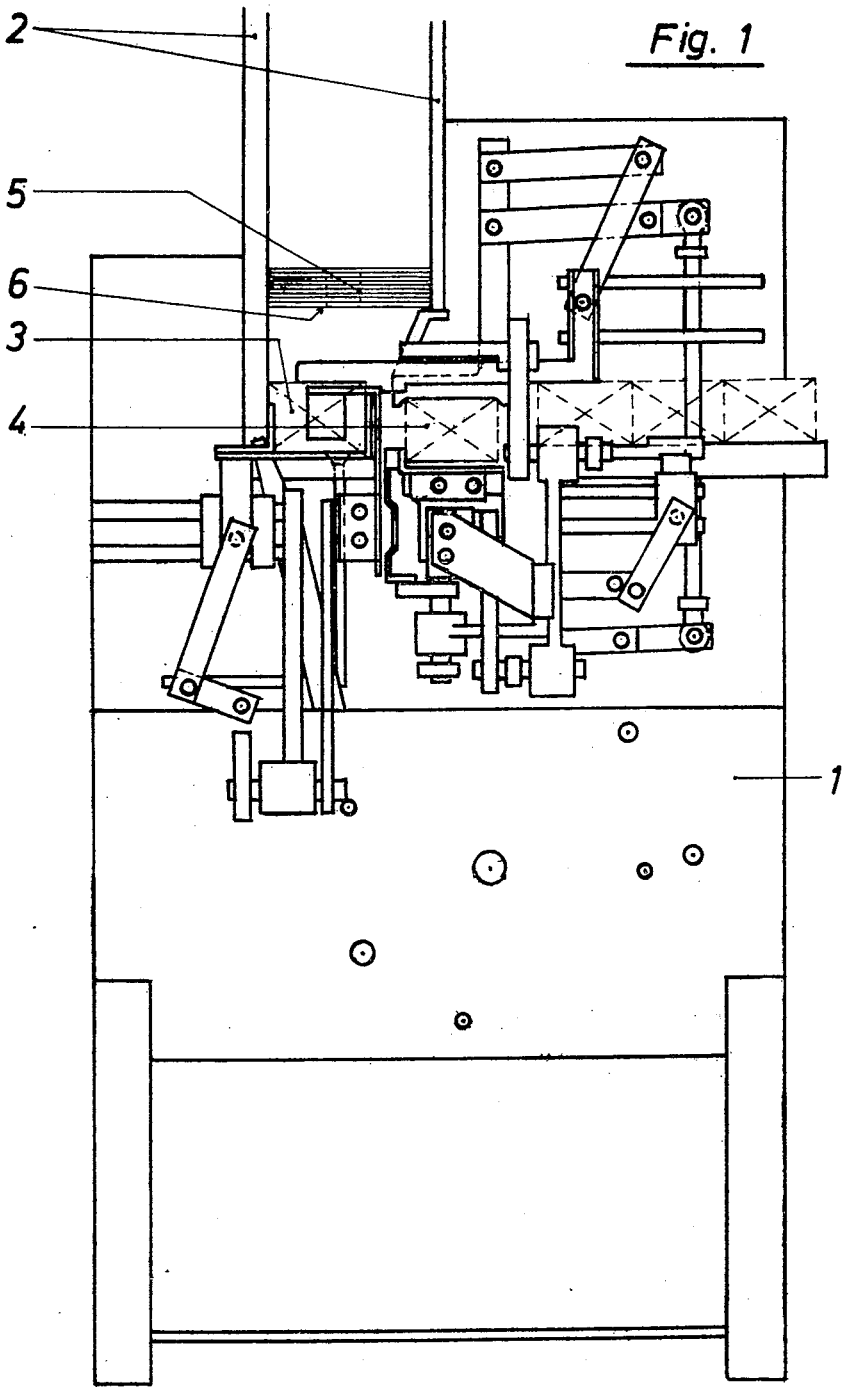
FIG. 1 is a front view of a packaging machine constructed in accordance with the invention.

Referring to the drawings in particular, the invention embodied therein, comprises a machine for opening flat foldable cartons or containers 5, and for thereafter filling them with a product or a multiplicity of such products, such as product 105 shown in FIG. 11, and for subsequently folding over side flaps and subsequently folding over and tucking in a top closure flap of the carton.

The packaging machine shown in FIG. 1 comprises a frame 1, having a lower closed portion containing a drive motor and driving mechanism with transmission elements necessary for the operation of the machine (not shown). In the upper part of frame 1, a magazine 2 for the flat folded boxes or cartons 5 is arranged over two laterally spaced working stations 3 and 4 defined by guide bars 11 and by a combination or a receiving member or bar 23 and a top holder or bar 13, respectively. The two stations 3 and 4 are associated with means for conveying the cartons from one station to the other stations (FIGS. 2 to 4); a device for supplying and filling the product to be packaged as shown in detail in FIGS. 11 to 14, and a mechanism for closing side and cover flaps to close the filled carton 5, as shown in detail in FIGS. 5 to 10. Foldable cartons 5 are piled in flat-folded state one on the other. During operation, the lowermost folding box 6 at the bottom end of the pile is removed by means of a suction head 7 mounted on a suction pipe 8 which is movable up and down in timed relationship to the pipe 8 by means of driving elements (not shown). Suction head 7 engages the bottom of the prefolded and glued folding box 5 and moves it downwardly with one side panel 45 of the box 5 gliding along or past deflection means comprising an unfolding block 9 mounted in an inclined position between magazine 2 and guide bar 11. During this motion, the folding box or carton is opened by deflection of side 45 and preliminarily righted to a sort of parallelepiped, and transferred into a frame compartment or first station 3 (FIG. 2) which is formed by support member 11 and a limiting bar 10 which is formed as a vertical connection to one end of the support member 11, and the contact surface 12 of a top bar or holder 13 when the bar is in a lowered position.

By means of contact surfaces 14, 15 of a shifting member 16 which is mounted on a slideway 17 and performs a rectilinear reciprocating motion under the action of a swing lever 20 pivoted at 19 and guided by rods 18, box 5, after it engages with its bottom 5B on bar 11, is pushed by the contact surface 15 against the limit bar 10, bringing it into upright position. The contact surface 14 of member 16 retains and covers the top 5T of the box from above. Thereby, box 5 is held on four sides in a position in station 3 in which it is ready for receiving the product to be packaged 105 (FIGS. 11 to 14 and FIG. 3).

Following the filling operation, a pusher or swing lever 22 which is pivoted at 21 engages the folding box on one side and executes a swinging motion along with the motion of shifting member 16. Both elements, 16 and 22, move into the transfer position shown in FIG. 4. Along with contact surfaces 14, 15 of shifting member 16, pusher 22 forms a holding frame or second station 4 for the box or carton 5. The bottom 5B of the box 5 first slides over guide bar 11 and then is received on a receiving bar 23 which is in lifted position.

Figure 2:
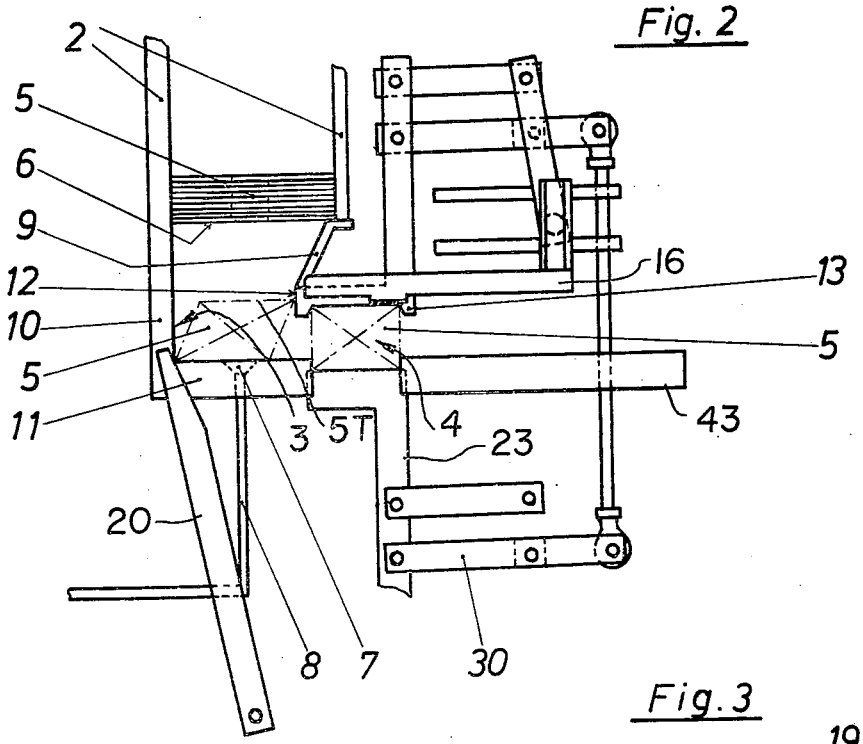
FIGS. 2, 3 and 4 are partial front elevational views similar to FIG. 1 showing various stages of removal, righting, holding and conveying of the flat foldable carton in the various operating phases.
Figure 3:
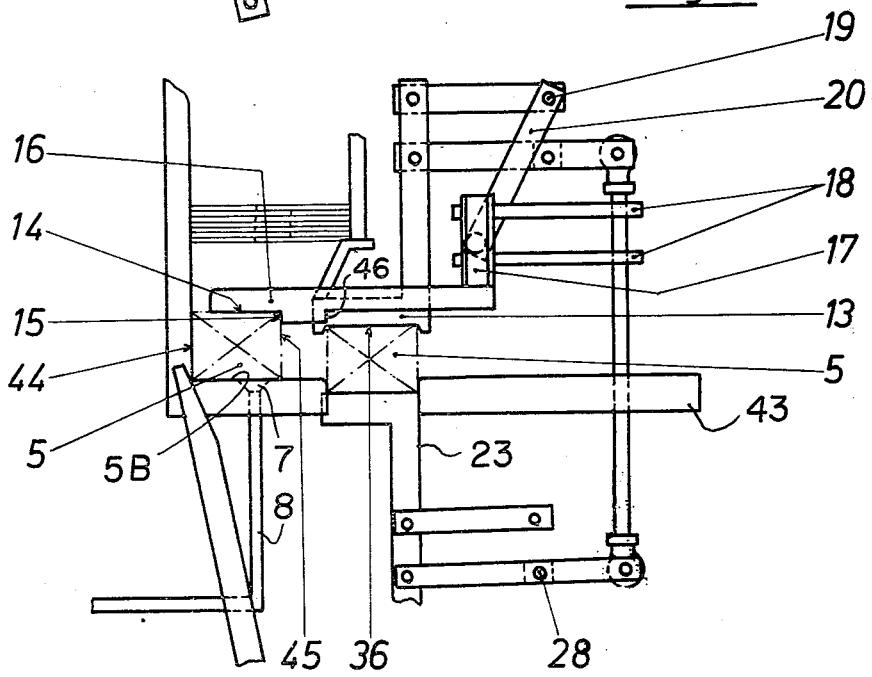

Receiving bar 23 is connected to bar 13 in a manner such that the path of travel of top bar 13 is longer than the path of travel of receiving bar 23. Therefrom, it results that in lifted position shown in FIG. 4, receiving bar 23 and top bar 13 are spaced apart from each other more than in the lowered position as shown in FIGS. 2 and 3. To obtain this effect, receiving bar 23 is hinged to swing levers 24, 25, which are pivoted at 26, 27, 28 and 29. At the same time, receiving bar 23 is connected, through links 30, 31, 32, 33 and 34 to top bar 13 which is provided with a recess or pocket 36. Top bar 13 is hinged to swing levers which are pivoted at 39, 40, 41 and 19.

During lowering of the holding frame formed by receiving bar 23 and top bar 13, folding box 5 is engaged on three sides by recess 36 and is moved downwardly. Thereby, shifting member 16 is disengaged from the folding box and the box is applied against receiving bar 23. In this lowered position, panel 44 of the folding box is braced, in its bottom portion, by the front surface of guide bar 11 and panel 45 of the folding box is laterally held by the front surface of an adjustable discharge bar 43. The position of the folding box before the lowering may be seen in FIG. 4, while a folding box held on four sides and ready for the closing operation in a lowered position forming station 4 is shown in FIGS. 2 and 3.

The operation of suction head 7 is synchronized with the drive of shifting member 16 and pusher 22 forming the holding frame for the folding box in a manner such that a new folding box or carton 5 is introduced into the frame compartment at station 3 formed by limiting bar 10, guide bar 11 and contact surface 12 of top bar 13 while the preceding folding carton is in the position at station 4 indicated in FIG. 2.

Figure 4:
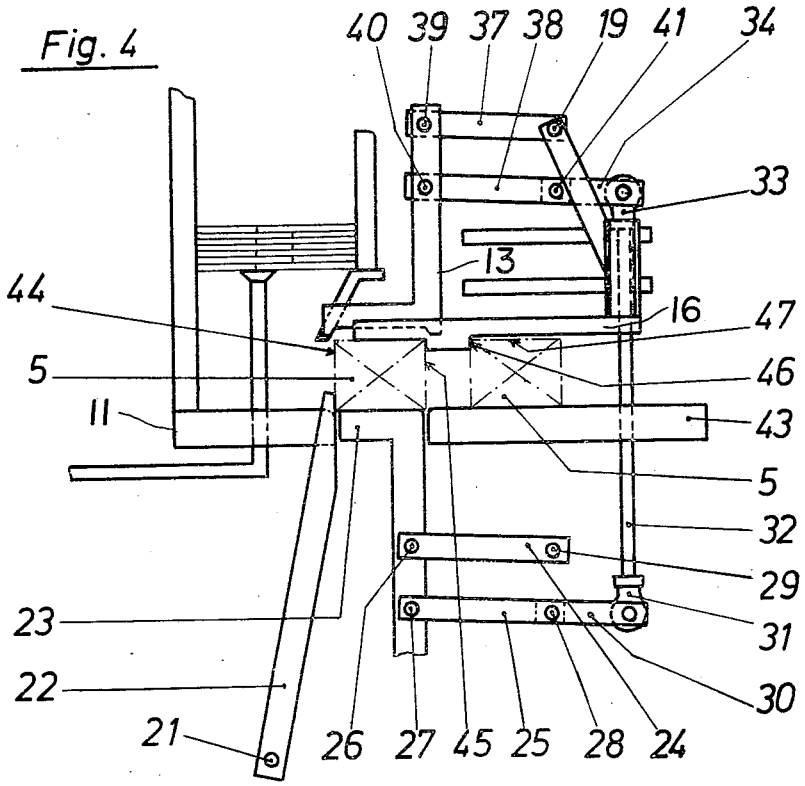
Figure 5:
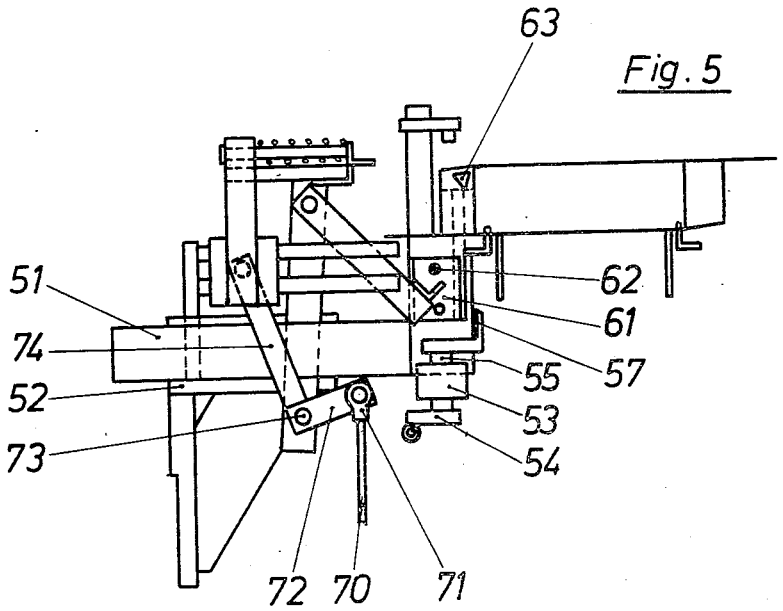
FIG. 5 is a side elevational view of the apparatus for closing the end flaps of the carton constructed in accordance with the invention.

The drive or shifting member 16 is also coordinated with the drive of pusher 22 so that member 16 moves toward the first working station only after folding box 5 has been brought into its upright position as a parallelepiped in the respective frame compartment, (FIG. 2). Due to this motion of shifting member 16, the folding box is fully righted, by contact surfaces 14, 15 of member 16, see FIG. 3, member 16 and pusher 22 are then displaced conjointly from first working station 3 to second working station 4, into a transfer position. During this motion, pusher 22 which is designed as a swing lever applies against the trailing side panel 44 of the folding box while shifting member 16, by means of its contact surface 15, braces the leading side panel 45 of the folding box. The holding frame formed by receiving bar 23 and top bar 13 which are conjointly driven in synchronism with shifting member 16 and pusher 22, is now lowered at station 4 into a position in which folding box 5 is disengaged from shifting member 16. The position before the lowering at station 4 is shown in FIG. 4.

In substantially the same period of time during which the folding box is being closed, at second working station 4, another box is removed from pile magazine 2 and is righted as well as filled, in the manner already described. Shifting member 16 and pusher 22, forming the transfer compartment, catch hold of the folding box which is next in the cycle. However, prior to their shifting motion, the folding box, which is first in the cycle and which in the meantime has been closed, is lifted from second working station 4. This closed box is supported by receiving bar 23, becomes disengaged from top bar 13 and is engaged in its position between working stations 3 and 4 by contact surfaces 46, 47 of the recess of shifting member 16 and, thereupon, is shifted, by means of contact surface 46, to discharge bar 43.

Second working station 4 is associated with the tuck-end closure units which are mounted at the front sides thereof. While in FIGS. 5 and 6, a tuck-end closure unit associated with the rear end of a folding box is shown, FIGS. 7 to 10 illustrate the individual, cyclic, working phases of this unit.

All component parts and functional elements necessary for closing the folding box are supported by or secured to a carrier bar 51 which is mounted in a slideway 52 for displacement in the longitudinal direction of the folding box. A side flap deflector 57 provided with a rounded portion 56 is secured to a pivot 55 which is supported by a bearing 53 and pivotable by means of a swing lever 54. The deflector executes a periodical swinging motion. Thereby, side flap 58 of the folding box is swung from its position aligned with side panel 44 into an inwardly folded position. At the opposite side, side flap 59 is swung from its position aligned with side panel 45 of the folding box into an inwardly folded position by means of folding guide 63 which is mounted on a slider 61 for reciprocating motion on guide rods 62 and which is designed, in its front portion, with a triangular cross-section and is provided with a rounded end 60.

Figure 6:
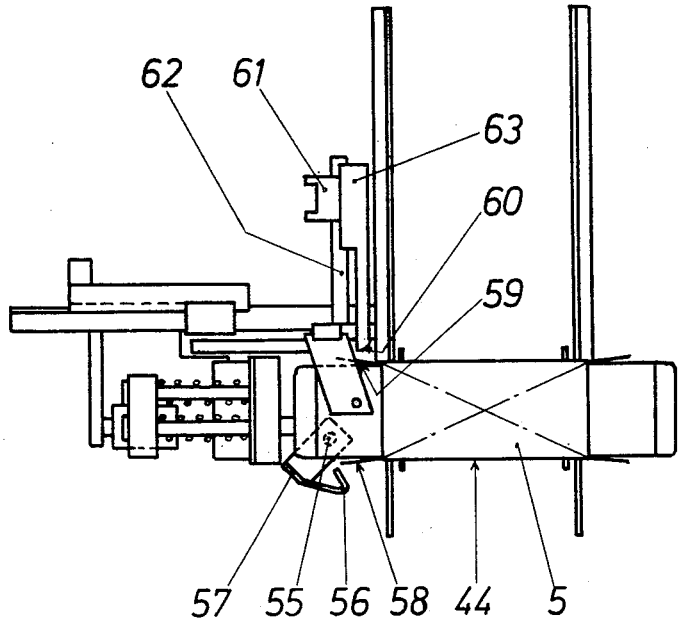
FIG. 6 is a plan view of the apparatus shown in FIG. 5.
Figure 7:
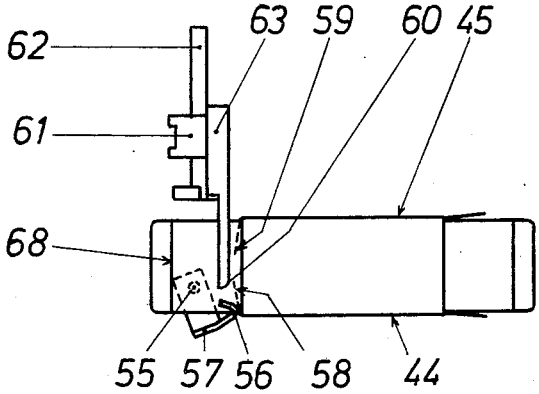

The drive of folding guide 63 is synchronized with the drive of side flap deflector 57 in a manner such that in its inwardly extended position, guide 63 engages also side flap 58 which has been swung inwardly by deflector 57 and, thereupon, swings deflector 57 back into the initial position thereof (FIGS. 6 and 7).

Figure 8:
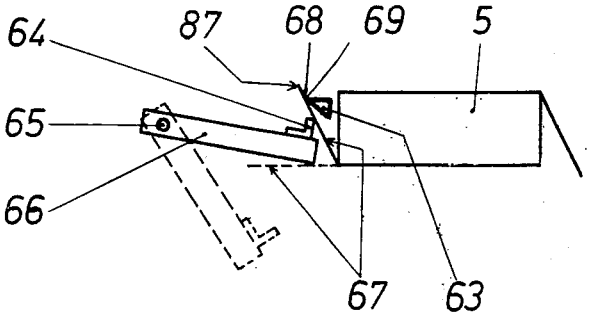

The drive of folding guide 63 is further synchronized with the drive of a lifter 64 which is carried by a lever 66 pivoted at 65 and intended for lifting the closing flap 67 of folding box 5 from its horizontal position into an upwardly inclined position. At the end of this motion, a score line 68 which is provided on closing flap 67 in the form of a groove or the like is applied against folding guide 63, namely, against the folding edge 69 thereof. The lifted closing flap 67 retained by lifter 64 is shown in FIG. 8, in which the initial position is also indicated in dotted lines.

A cam disc (not shown) is provided with three differently sloping surfaces, as well as with three different radii. This cam disc is synchronized with the drives of side flap deflector 57, folding guide 63 and lifter 64, through a contact roller (also not shown). The cam disc causes the pivoting of a swing lever (not shown). This lever effects, through connecting members 70, 71, the advancing and retracting motion of a double stroke pusher in a manner such that the advance takes place in two partial strokes of unequal length and the retraction takes place in a single stroke. Connecting members 70, 71 (FIG. 5) are coupled to swing levers 72, 74 which are pivoted at 73. The double stroke pusher comprises the members 80, 81, 82, 83 and 84 and is mounted on a support 79 and connected to a slider 78.

A guide roller 75 mounted on swing lever 74 for rotation about a pivot pin 76 is engaged in the slideway 77 of slider 78. Guided on guide bars 86 which are secured to a support 85, slider 78 is thereby adapted to execute both the advance and the retracting motion. While executing the first partial stroke of the advance, tuck-end portion 87 (FIG. 8) of closing flap 67 is folded, at edge 69. As shown in FIG. 9, a folding angle 82 which is carried on guide rods 80 and biased by compression springs 81, and covered from above in a manner such that the leading edge of tuck end portion 87 is brought into a position close in front of folding box 5. During the second partial stroke, tuck end portion 87 is introduced into the folding box while gliding on the underside of folding angle 82 now serving as a guide.

To effect the second partial stroke, a stop 89 is provided which is carried by a support 88 and stops the folding angle 82 so that a closing plate 84 secured to a strip 83 advances below the folding angle and pushes tuck end portion 87 completely into the folding box. For this purpose, guide rods 80 carrying folding angle 82 are mounted for displacement in support 79 and folding angle 82 is biased by compression springs 81, see FIGS. 9 and 10.

First working station 3 is associated with a pocket 91 for the products to be packaged (see FIGS. 11 to 14). The pocket is provided at the front side of the box and is shiftable transversely thereto. The driving mechanisms for pocket 91 as well as for a pusher 108 are synchronized with the drives of the conveying elements of the folding box and of the functional members of the tuck-end closure unit. This ensures a correct transfer of the product to be packaged from pocket 91 into the folding box ready for receiving.

Figure 13:
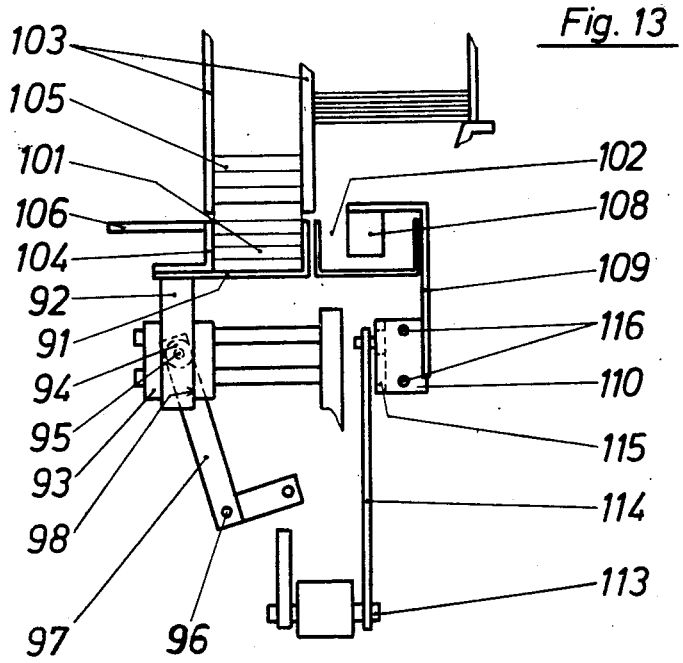
FIG. 13 is a front view of the filling device shown in FIG. 11.

Pocket 91 is carried on a support 92 and is mounted, along therewith, on a common slide 93 (FIG. 13). A guide roller 94 engages the guideway 98 of slide 93 whereby a periodic movement from a charging position 101 laterally into a filling position 102 is imparted to slide 93 and pocket 91. To this end, guide roller 94 is pivoted at 95 to swing lever 97 which, in turn, is pivotally mounted at 96. Slide 93 is guided by means of guide bars 100 which are secured to a support 99.

If an automatic charging of pocket 91 from a pile magazine 103 is provided, rear side wall 104 of pocket 91 acts as a pusher by means of which, for example, a pilable product 15 is pushed out of pile magazine 103. A support 106 which is secured to side wall 104 of pocket 91 is intended to form the magazine bottom for the product pile during the phase in which pocket 91 is shifted into its filling position, and to clear the discharge end of pile magazine 103 during the phase in which pocket 91 is shifted into its charging position.

Pusher 108 is secured to a bracket 109 and is mounted, along therewith, on a slider 110. A guide roller 111, mounted at the center of rotation 112 of a swing lever 114 which, in turn, is pivoted at 113, engages the guideway 115 of slider 110. Slider 110, along with pusher 108, execute a periodic reciprocating motion. The stroke of this motion is slightly longer than the length of pocket 91 so that an overtravel takes place at both sides. Slider 110 is guided by means of guide rods 116.

Figure 14:
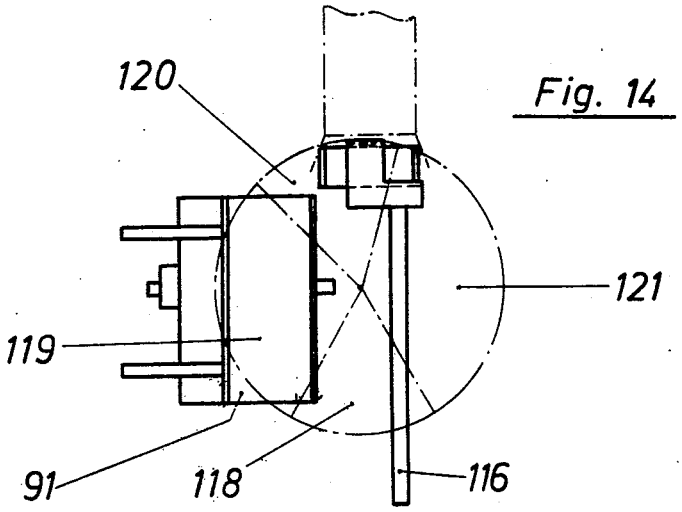
FIG. 14 is a top plan view of the filling device shown in FIG. 13.

In FIGS. 12 and 14, a circle is diagrammatically indicated which is subdivided into four sectors of circle. The circle corresponds to one full revolution of the cycle-controlled shaft of the machine. Within the period corresponding to sector 119, pocket 91 stands still so that a filling of the box by means of pusher 108 can take place and during the period of sector 120, pusher 108 executes its overstroke. Thereby, product 105 to be packaged is pushed, through a guide member 117, into folding box 5, whereupon, pocket 91 is shifted back from its filling position into its charging or supply position. Finally, during the period of sector 121, pocket 91 is ready for charging in its supply position while pusher 108 executes its idle return stroke.

Even if not belonging to the invention and, therefore, not shown, it is easily possible to complement the inventive packaging machine in an advantageous manner with a device for automatic feeding of prospectus, folders or the like.

While specific embodiments of the invention have been shown and described in detail to illustrate the application of the principles of the invention, it will be understood that the invention may be embodied otherwise without departing from such principles.

I claim:

1. A machine for erecting, filling and closing a rectangular carton having hinged top, bottom and side walls which is flat-foldable for stacking before erection and which has foldable end flaps at each end for closing it, comprising a magazine having spaced walls for stacking a plurality of cartons in a flat-folded position therebetween, a support bar defining a first station located below said discharge opening, deflection means between said support bar and said magazine for deflecting a side wall of the carton upwardly so as to erect the side walls and top above the bottom and to permit the bottom to fall on said support bar, an engagement member movable to engage each carton in succession and to move it past said deflection means and deposit it on said support bar, a shifting member movable backwardly and forwardly over said support bar and being movable against a side wall of said carton to deflect it to a fully upright erected position and to hold it in an erected condition on said support bar, means adjacent said first station for filling the erected carton with a product, a movable receiving bar being positionable alongside said support bar in a position to receive the filled carton therefrom, a top enngagement bar engageable with the top of the filled carton when it is positioned on said receiving bar, said receiving bar and said top engagement bar being movable together with said carton to a second station spaced from said first station, pusher means for engaging the filled carton and moving it out of said first station onto said receiving bar and between said receiving bar and said top engagement bar and closing means at said second station for folding said foldable end flaps.

2. A machine for erecting, filling and closing a rectangular carton, according to claim 1, wherein said guide bar includes a vertical limit bar portion at one end against which the carton is pushed to effect the erection thereof, said shifting member having a top surface engageable on the top of said carton and a side surface engageable with the side of said carton.

3. A machine for erecting, filling and closing a rectangular carton, according to claim 1, wherein said shifting member cooperates with said pusher when said carton is moved from said first station to said second station.

4. A machine for erecting, filling and closing a rectangular carton, according to claim 1, wherein said receiving bar includes a surface for supporting the bottom of the filled carton which is longer than the length of the carton bottom.

5. A machine for erecting, filling and closing a rectangular carton, according to claim 1, including a discharge bar located alongside said second station in alignment with said receiving bar, said discharge bar being at an adjustable spacing from said support bar, the spacing corresponding to the width of the carton to be handled at the second station.

6. A machine for erecting, filling and closing a rectangular carton, according to claim 1, including an adjustable discharge bar spaced away from said support bar, said receiving bar being movable mounted between said support bar and said discharge bar being mounted for swinging movement therebetween, said top bar and said receiving bar being mounted for movement together through paths which are different in length so that said top bar moves through a longer path of travel than said receiving bar and thereby effects the movement of the container from said support member to said receiving bar.

7. A machine for erecting, filling and closing a rectangular carton, according to claim 6, wherein said top bar includes a bottom surface with a recess forming a pocket engageable over and on each side of the container.

8. A machine for erecting, filling and closing a rectangular carton, according to claim 1, wherein said pusher comprises a pivotal lever which is movable against one side of said container to shift it off said support member onto said receiving bar, said shifting member having a surface engageable with the opposite side of said container and cooperating with said pusher to move it from said support member to said receiving bar.

9. A machine for erecting, filling and closing a rectangular carton having hinged top, bottom and side walls which is flat-foldable for stacking before erection and which has a side flap hinged to each side wall and a top cover flap hinged to at least one of the top or bottom walls at each end, comprising a magazine for storing a plurality of flat-foldable cartons in a stack and having a bottom discharge opening, a support member located below said discharge opening, deflection means between said support member and said magazine for deflecting a side wall of the carton upwardly so as to erect the side walls and top above the bottom, an engagement member movable to engage each carton in succession and to move it past said deflection means and deposit it on said support member, a shifting member movable backwardly and forwardly over said support member and having a top surface engageable over the top of the carton and a side surface engageable with one side of the carton and being movable against the side of the carton to move the carton upwardly to an upright position and hold it in an erected condition, the position of said carton on said support member, held in an erected condition by said shifting member, comprising a first station, product stuffer means at said first station including a product magazine for storing a stack of individual products to be filled into said carton located alongside said support member and including a movable product support member carrying the lower portion of the stack of products and being movable away from the stack to transport the lower portion away from the stack and to support the remaining portion of the stack, a product pusher means engageable with the removed portion of the stack of products to push them into the erected container from an end thereof, cooperative second station forming members including a receiving member having a top receiving surface on which the filled carton is supportable and a top engagement member engageable over the top of the filled carton being movable with the engaged carton to position it in a second station, a pusher member movable behind the filled carton at the first station to position it on said receiving member, said receiving member and said top engagement member being articulated so that they move through a path in which said top engagement member moves over the container to hold it in position and to locate it at a second station, and flap closing means at said second station engageable with said side and cover flaps to first fold the side flaps to a closed position and then to fold the cover flap thereover, said folding means including a side flap deflector engageable with one side flap for deflecting it into a closed position, a slide member movable to engage the other side flap and fold it inwardly from the other side to a closed position and lifter members for lifting the cover flap from a horizontal position and swinging it upwardly over the side flaps into a closed position.

10. A machine for erecting, filling and closing a rectangular carton, according to claim 9, wherein said flap closing means includes a position member adapted to overlie an edge of the container, said lifter comprising a pivotal member movable upwardly from beneath the cover flap to move it to an oblique upward position, a folding guide movable between the cover flap and the carton walls positionable at a spaced location from the end of the cover flap and in a location so as to bend the end of the cover flap against the guide member and to guide its insertion into the interior of the container over the side flaps.

11. A machine for erecting, filling and closing a rectangular carton, according to claim 10, including first and second carrier bars located at said second station at spaced locations from each other and including a closing mechanism on each carrier bar and means for adjusting the spacing between said closing mechanisms to accommodate for the length of the carton.

12. A machine for erecting, filling and closing a rectangular carton, having hinged top, bottom and side walls and which is flat-foldable for stacking before erection and which has foldable end flaps at each end for closing it, comprising a magazine for storing a plurality of flat-folded cartons in a stack and having a discharge opening, a support member defining a first station support located in spaced relationship to the discharge opening, deflection means between said discharge opening and said support member for deflecting a side wall of the carton upwardly so as to erect the carton, an engagement member movable to engage each carton in succession to move it past said deflection means and deposit it on said support member, a shifting member movable backwardly and forwardly over said support bar to engage a side of the carton and to move it to a fully upright position, said support bar having means on the opposite side from said shifting member engagement side providing a stop against which the carton is moved, said carton being held in the erected position on said support member in a first station, a product stuffer located alongside said first station including a product magazine for storing a stack of individual products to be filled into said carton, said magazine including a lowermost tray portion for containing the lowermost products in the stack, means for moving the product support tray laterally of said stack to remove the lowermost ones of said products, said tray having means for retaining the remaining products when said tray is moved, said tray being moved into the product stuffing position, a product pushing member located in said product stuffing position aligned with an opened end of said erected carton, said pusher member being movable to push the products into the carton, cooperative second station forming members including a receiving member alongside said support member and a top engagement member engageable over the top of the carton, said pusher for pushing the filled carton from said first station onto said receiving member, said receiving member and said top engagement member being movable through paths to cause the top engagement member to move over the carton after it is placed on the receiving member and together to move said carton to a second station at which the carton is held by said receiving member and said top engagement member, and flap closing means at said second station for folding said foldable end flaps to close said carton.

13. A machine for erecting, filling and closing a rectangular carton, according to claim 12, including a tray guide bar, said product tray being movable along said guide bar, said tray including a bottom plate portion receiving the products at the lowermost end of said stack when said tray is positioned below said stack and having a raised portion on said plate adjacent the tray portion forming a support ledge which is simultaneously movable under the bottom of the stack as the tray portion with the lowermost products of the stack is moved out of the stack.

* * * * *